US010490382B2

(12) United States Patent
Nakano

(10) Patent No.: US 10,490,382 B2
(45) Date of Patent: Nov. 26, 2019

(54) SLOW-WAVE CIRCUIT

(71) Applicant: NEC NETWORK AND SENSOR SYSTEMS, LTD., Fuchu-shi, Tokyo (JP)

(72) Inventor: Takashi Nakano, Tokyo (JP)

(73) Assignee: NEC NETWORK AND SENSOR SYSTEMS, LTD., Tokyo (JP)

( * ) Notice: Subject to any disclaimer, the term of this patent is extended or adjusted under 35 U.S.C. 154(b) by 0 days.

(21) Appl. No.: 16/080,717

(22) PCT Filed: Mar. 8, 2017

(86) PCT No.: PCT/JP2017/009283

§ 371 (c)(1),
(2) Date: Aug. 29, 2018

(87) PCT Pub. No.: WO2017/154987

PCT Pub. Date: Sep. 14, 2017

(65) Prior Publication Data

US 2019/0122848 A1 Apr. 25, 2019

(30) Foreign Application Priority Data

Mar. 10, 2016 (JP) ..... 2016-047258

(51) Int. Cl.
*H01J 23/24* (2006.01)
*H01J 25/38* (2006.01)

(52) U.S. Cl.
CPC ..... *H01J 23/24* (2013.01); *H01J 25/38* (2013.01)

(58) Field of Classification Search
None
See application file for complete search history.

(56) References Cited

U.S. PATENT DOCUMENTS 2,922,917 A * 1/1960 Kompfner ..... H01J 23/30 315/3.5
2,957,102 A * 10/1960 Flannery ..... H01J 23/0873 315/3.5

(Continued)

FOREIGN PATENT DOCUMENTS

CN 101615553 A 12/2009
CN 202940212 U 5/2013

(Continued)

OTHER PUBLICATIONS

Khanh T. Nguyen et al., "Design Methodology and Experimental Verification of Serpentine/Folded-Waveguide TWTs", IEEE Transactions on Electron Devices, vol. 61, No. 6, June 2014, pp. 1678-1686 (8 pages total).

(Continued)

*Primary Examiner* — Dion Ferguson
*Assistant Examiner* — Srinivas Sathiraju

(57) ABSTRACT

A slow-wave circuit is provided with a folded waveguide and a beam hole. The beam hole is arranged between an edge and a center in the direction of width of the folded waveguide. The beam hole is preferably arranged at an edge in the direction of width of the folded waveguide, at a position that does not protrude beyond the folded waveguide. The beam hole is preferably arranged at a position separated by a prescribed distance from the edge in the direction of width of the folded waveguide.

7 Claims, 9 Drawing Sheets

(56) References Cited

U.S. PATENT DOCUMENTS

| | | | | | |
|---|---|---|---|---|---|
| 2,985,791 | A * | 5/1961 | Bates | H01J 23/0873 | 315/3.5 |
| 2,985,792 | A * | 5/1961 | Bates | H01J 23/0873 | 315/3.5 |
| 3,010,047 | A * | 11/1961 | Bates | H01J 23/24 | 315/3.5 |
| 3,066,237 | A * | 11/1962 | Nevins, Jr. | H01J 23/24 | 313/153 |
| 3,175,119 | A * | 3/1965 | Belohoubek | H01J 23/083 | 315/3.5 |
| 3,181,024 | A * | 4/1965 | Sensiper | H01J 25/38 | 315/3.5 |
| 3,268,761 | A * | 8/1966 | Mann | H01J 23/26 | 315/3.6 |
| 3,400,297 | A * | 9/1968 | Miyamoto | H01J 23/24 | 315/3.5 |
| 3,466,576 | A * | 9/1969 | Bert | H01J 23/36 | 313/39 |
| 4,951,380 | A * | 8/1990 | Smith | H01J 23/165 | 29/600 |
| 5,179,862 | A * | 1/1993 | Lynnworth | G01F 1/662 | 73/861.28 |
| 7,952,287 | B2 * | 5/2011 | Barnett | H01J 25/34 | 315/3.5 |
| 8,179,048 | B2 | 5/2012 | Dayton, Jr. et al. | | |
| 8,618,736 | B2 | 12/2013 | Dayton, Jr. et al. | | |
| 8,624,494 | B2 | 1/2014 | Dayton, Jr. et al. | | |
| 8,624,495 | B2 | 1/2014 | Dayton, Jr. et al. | | |
| 8,847,490 | B2 | 9/2014 | Dayton, Jr. et al. | | |
| 8,884,519 | B2 | 11/2014 | Dayton, Jr. et al. | | |
| 9,082,579 | B2 | 7/2015 | Baik et al. | | |
| 9,406,477 | B2 * | 8/2016 | Tarhani | H03F 3/58 | |
| 2001/0013757 | A1 * | 8/2001 | Theiss | H01J 23/22 | 315/3.5 |
| 2008/0272698 | A1 | 11/2008 | Dayton et al. | | |
| 2012/0176034 | A1 | 7/2012 | Dayton, Jr. et al. | | |
| 2012/0181927 | A1 | 7/2012 | Dayton, Jr. et al. | | |
| 2012/0181930 | A1 | 7/2012 | Dayton, Jr. et al. | | |
| 2012/0187832 | A1 | 7/2012 | Dayton, Jr. et al. | | |
| 2012/0248979 | A1 | 10/2012 | Dayton, Jr. et al. | | |
| 2013/0200789 | A1 | 8/2013 | Baik et al. | | |

FOREIGN PATENT DOCUMENTS

| | | | |
|---|---|---|---|
| JP | 2010-519695 | A | 6/2010 |
| JP | 2013-161794 | A | 8/2013 |

OTHER PUBLICATIONS

Li Ke, et al., "Dispersion Characteristics of Two-Beam Folded Waveguide for Terahertz Radiation", IEEE Transactions on Electron Devices, vol. 60. No. 12, Dec. 2011, pp. 4252-4257 (6 pages total).
International Search Report dated Jun. 6, 2017 issued by the International Searching Authority in No. PCT/JP2017/009283.
Written Opinion dated Jun. 6, 2017 issued by the International Bureau in No. PCT/JP2017/009283.
Chinese Office Action for CN Application No. 201780015764.X dated Jul. 29, 2019 with English Translation.

* cited by examiner

SLOW-WAVE CIRCUIT

CROSS-REFERENCE TO RELATED APPLICATIONS

The present application claims priority from Japanese Patent Application No. 2016-047258 (filed on Mar. 10, 2016), the content of which is hereby incorporated in its entirety by reference into this specification.

TECHNICAL FIELD

The present invention relates to a slow-wave circuit. In particular the invention relates to a slow-wave circuit for a traveling-wave tube.

BACKGROUND

A traveling-wave tube is often used as a transmission source amplifier for a high frequency wave (microwave). The traveling-wave tube is a means for amplifying a high frequency wave (electromagnetic wave) for transmission, through interaction while making it travel in the same direction as an electron beam that is an amplification energy source. With regard to an amplification operation in the traveling-wave tube, it is necessary to divert a high frequency wave of high speed in order to have the speed in direction of travel of the electron beam and of the high frequency wave to be of a similar level. That is, a slow-wave circuit that delays the high frequency wave is necessary.

As a method of delaying a high frequency wave (diverting a high frequency wave), there is a method, for example, in which the high frequency wave is propagated in a helical waveguide, and an electron beam is passed at the center of the waveguide. The helical waveguide portion that diverts the high frequency wave in this way is called a helix slow wave circuit.

Meanwhile, there is presently a strong demand for high frequency waves with regard to wireless frequency. Specifically, research and development of wireless devices in the terahertz range is progressing. With the progress of high frequency waves from microwaves to terahertz waves, since wavelength becomes smaller (since wavelength shortens), miniaturization of "helical wiring" occurs in the abovementioned helix slow wave circuit, and manufacture of the circuit becomes difficult.

Therefore, in the high frequency wave band described above (for example, terahertz range), a "folded waveguide" form, for which microstructure realization is comparatively easy, is viewed as being promising, and research and development is proceeding. In the folded waveguide, a high frequency wave (electromagnetic wave) is made to pass a waveguide bent in meander line form, and is delayed. The traveling-wave tube (waveguide) has a configuration provided with a beam hole so that an electron beam travels (passes through) the center thereof.

Specifically, the folded waveguide has a structure as shown in FIG. 8, with a configuration in which a beam hole 10 passes through the center of the folded waveguide 20. It is to be noted that details of the configuration of the traveling-wave tube provided with the folded waveguide and a stopband described later are disclosed in Non-Patent Literature 1.

PATENT LITERATURE 1

Japanese Translation of PCT International Publication, Publication No. 2010-519695A

NON-PATENT LITERATURE 1

Khanh T. Nguyen, etc., Design Methodology and Experimental Verification of Serpentine/Folded-Waveguide TWTs", IEEE Trans. on E.D., Vol. 61, No. 6, JUNE 2014.

SUMMARY

It is to be noted that the respective disclosures of the abovementioned cited technical literature are incorporated herein by reference thereto. The following analysis is given according to the present inventor.

With regard to a folded waveguide, there is progress in structural miniaturization along with having higher frequency waves for wireless frequencies (shrinking of the size of a waveguide that is bent in a meander line). However, concerning a beam hole, since a prescribed electron beam has to be passed through, shrinking relative to the waveguide is difficult, and the ratio of the beam hole to the overall configuration of the waveguide increases. As the ratio of the beam hole increases, frequency deviation of phase velocity increases, a stopband appears, and it becomes difficult to secure a wide band for a traveling-wave tube.

For the configuration shown in FIG. 8, FIG. 9 is a diagram showing frequency characteristic of phase velocity Vp normalized to the speed of light c (Vp/c; Vp is phase velocity, c is the speed of light). FIG. 9 shows difference of frequency characteristic of phase velocity Vp according to presence/absence of beam hole. In the following description, using simply the denotation phase velocity Vp/c indicates phase velocity Vp normalized to the speed of light c.

Referring to FIG. 9, it is understood that in a case where no beam hole is present, the slope of the phase velocity Vp/c is small in the vicinity of 300 GHz, but in a case where a beam hole is present, the slope becomes large. Furthermore it is understood that a stopband appears from the vicinity of 330 GHz. That is, in the example of FIG. 9, wireless frequency is of the order of 300 GHz, and if the ratio of what the beam hole takes with respect to the waveguide, increases, the drawing shows that the slope of Vp/c–f (f: frequency) increases and the stopband appears.

In the traveling-wave tube, when the electron beam velocity and the phase velocity Vp of the high frequency wave (electromagnetic wave) are about the same, interaction is strong, and high amplification gain is obtained. In other words, since the electron beam velocity is constant, when the slope of Vp/c–f is large, the range in which both velocities are about the same decreases, and the band in which gain is obtained decreases.

It is an object of the present invention to provide a slow-wave circuit that contributes to securing wide range bandwidth for a folded waveguide.

According to an aspect of the present invention there is provided a slow-wave circuit having a folded waveguide and a beam hole arranged between an edge and a center in a direction of width of the folded waveguide.

According to the present invention there is provided a slow-wave circuit that contributes to securing wide range bandwidth for a folded waveguide.

PREFERRED MODES

Figure 1:
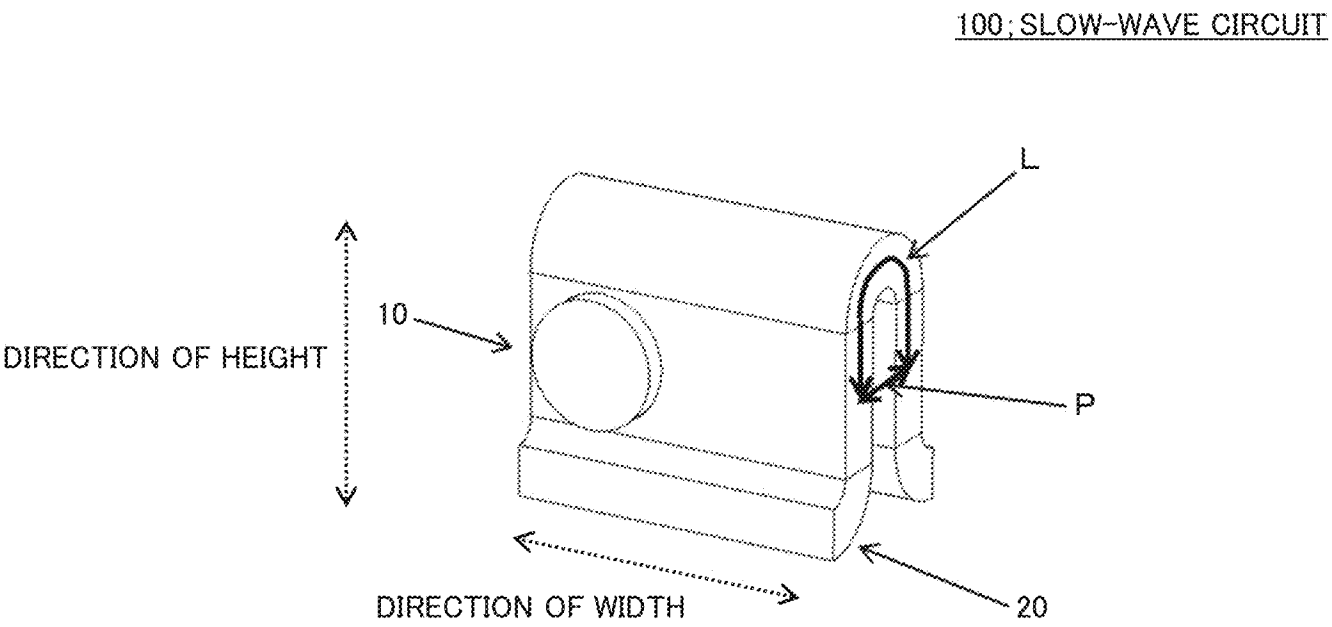
FIG. 1 is a perspective diagram showing a configuration example of an edge of a slow-wave circuit according to a first exemplary embodiment.

First, a description is given concerning an outline of an exemplary embodiment. It is to be noted that reference symbols in the drawings attached to this outline are added to respective elements for convenience, as an example in order to aid understanding, and there is no intention to limit the invention in any way.

Figure 8:
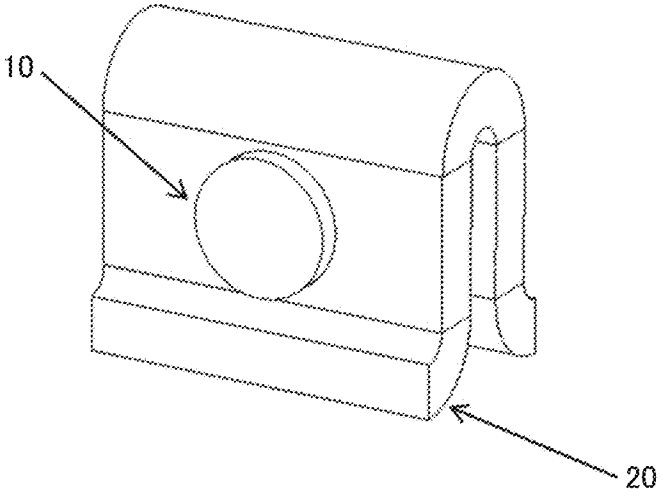
FIG. 8 is a perspective diagram showing an example of the structure of a folded waveguide.
Figure 9:
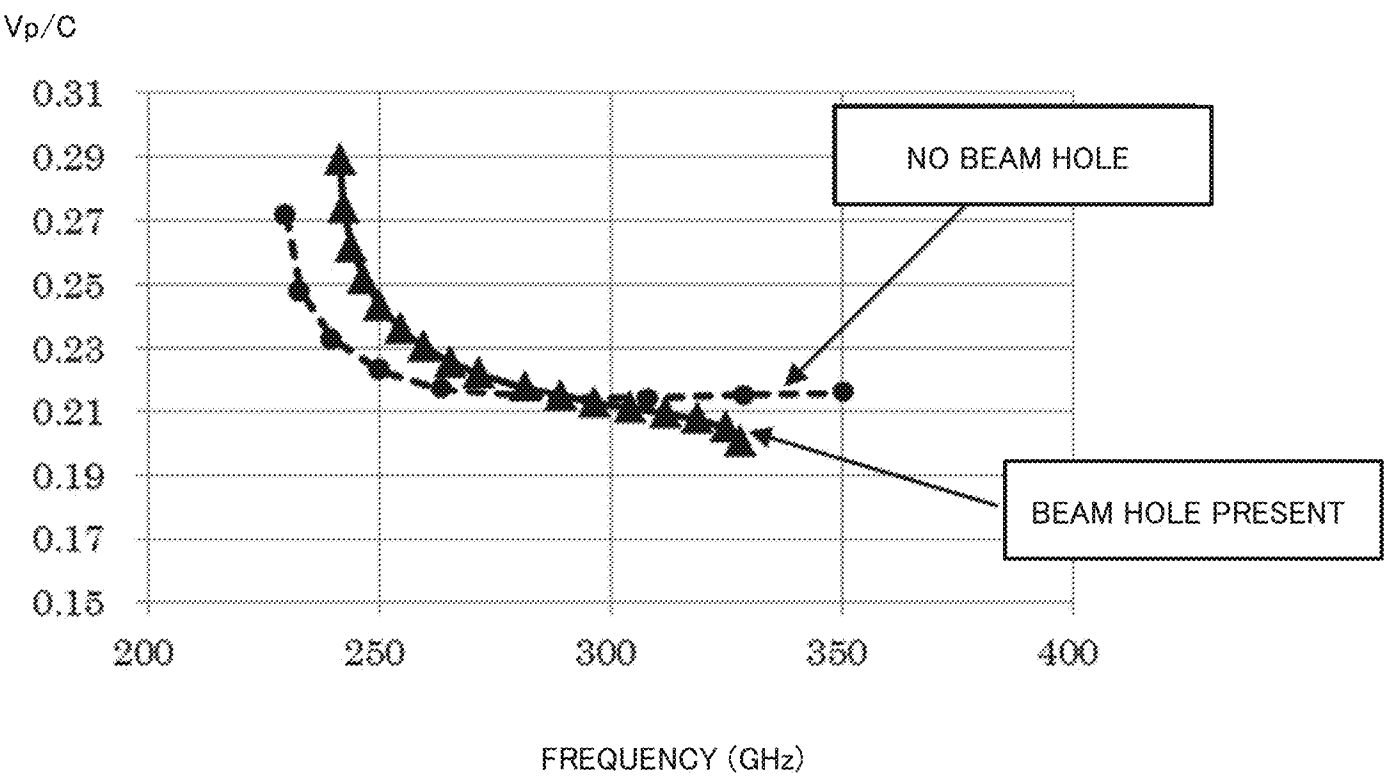
FIG. 9 is a diagram showing frequency characteristic of phase velocity Vp normalized to the speed of light c, in the configuration shown in FIG. 8.

As shown in FIG. 1, a slow-wave circuit 100 according to the exemplary embodiment is provided with a folded waveguide 20 and a beam hole arranged between an edge and a center in the direction of width of the folded waveguide 20. Namely, the slow-wave circuit 100 according to the exemplary embodiment, having a traveling-wave tube with the form of the folded waveguide 20, is provided with the beam hole 10 formed at the edge of the waveguide, not the center of the waveguide as shown in FIG. 8.

Details are described later, but with the abovementioned configuration it is possible to have the slope approach flatness in a usage band with regard to frequency characteristic of phase velocity in the traveling-wave tube, and to reduce stopband. According to the abovementioned configuration, it is possible to realize a broadband traveling-wave tube, or, it is possible to improve the degree of freedom in band design to match an objective.

A more detailed description is given concerning specific exemplary embodiments below, making reference to the drawings. It is to be noted that in each of the exemplary embodiments, the same reference symbols are attached to the same configuration elements and descriptions thereof are omitted.

First Exemplary Embodiment

A more detailed description is given concerning a first exemplary embodiment, using the drawings.

FIG. 1 is a perspective diagram showing a configuration example of an edge of a slow-wave circuit 100 according to the first exemplary embodiment. Referring to FIG. 1, a beam hole 10 is formed at the edge in the direction of width of a folded waveguide 20. With regard to arrangement of the beam hole 10 in the direction of height of the folded waveguide 20, the beam hole 10 is arranged in the center of the folded waveguide 20.

The folded waveguide 20 is a path for a high frequency wave (electromagnetic wave), the beam hole 10 is a path for an electron beam. That is, in the first exemplary embodiment, by an electromagnetic wave being guided in the folded waveguide 20, and the electron beam being guided in the beam hole 10, the slow-wave circuit 100 operates as a traveling-wave tube that amplifies the electromagnetic wave. It is to be noted that in the first exemplary embodiment, the tube length 2L for 1 period is 6.64 mm, and the length 2P for 1 period is 1.48 mm.

The structure shown in FIG. 1 is repeated to form the slow-wave circuit 100 according to the first exemplary embodiment.

Figure 2:
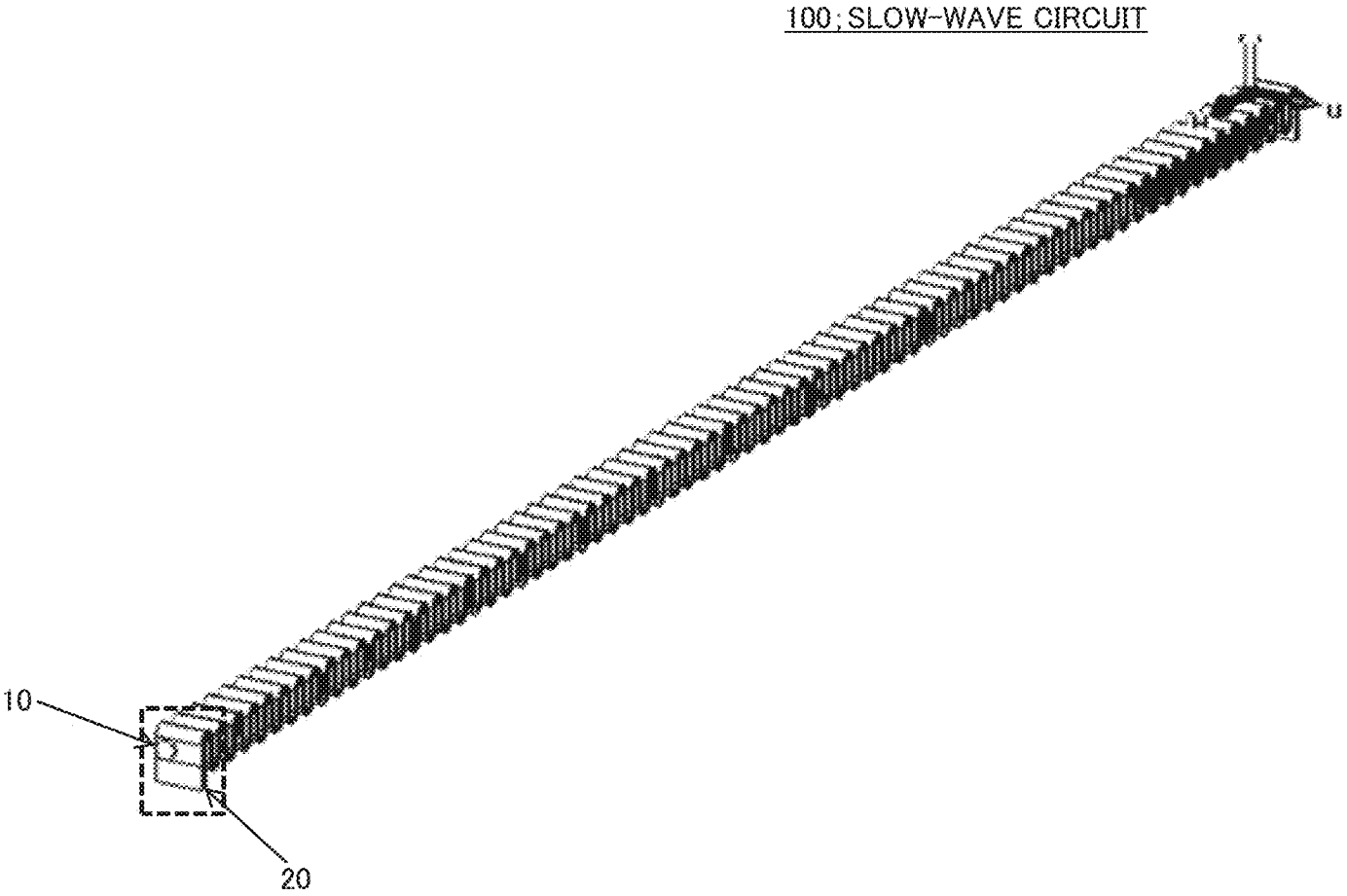
FIG. 2 is a perspective diagram showing an example of an overall configuration of the slow-wave circuit according to the first exemplary embodiment.

FIG. 2 is a perspective diagram showing an example of an overall configuration of the slow-wave circuit 100 according to the first exemplary embodiment. In FIG. 2, the extracted broken line region (1 period in meander line shape) corresponds to FIG. 1. The slow-wave circuit 100 shown in FIG. 2 is obtained by setting out the configuration shown in FIG. 1 in 73 stages. That is, by setting out the configuration shown in FIG. 1 in 73 stages, a traveling-wave tube (slow-wave circuit) for 1 folded waveguide is formed.

It is to be noted that FIG. 1 and FIG. 2 are drawings for input of electromagnetic field simulation, and only spatial portions are denoted. In actuality, the surroundings of boundaries shown in FIG. 1 and FIG. 2 have a structure covered by a conductor such as copper (Cu) or the like.

It is to be noted that, as a method of manufacturing the slow-wave circuit 100, consideration may be given to a method of dividing the form of FIG. 2 into left and right with the beam hole 10 as center, and pasting them together (for example, a method of forming a dummy shape as a split core, and pasting them together after depositing a metal membrane on each thereof); and a method of forming it in one go (for example, a method of sequentially laminating outer wall metal, or a method of first forming a dummy shape as core, depositing a metal membrane, and thereafter removing the core dummy shape). Or, use of on-chip MEMS (Micro Electro Mechanical Systems) or a 3D printer may be considered.

Figure 3:
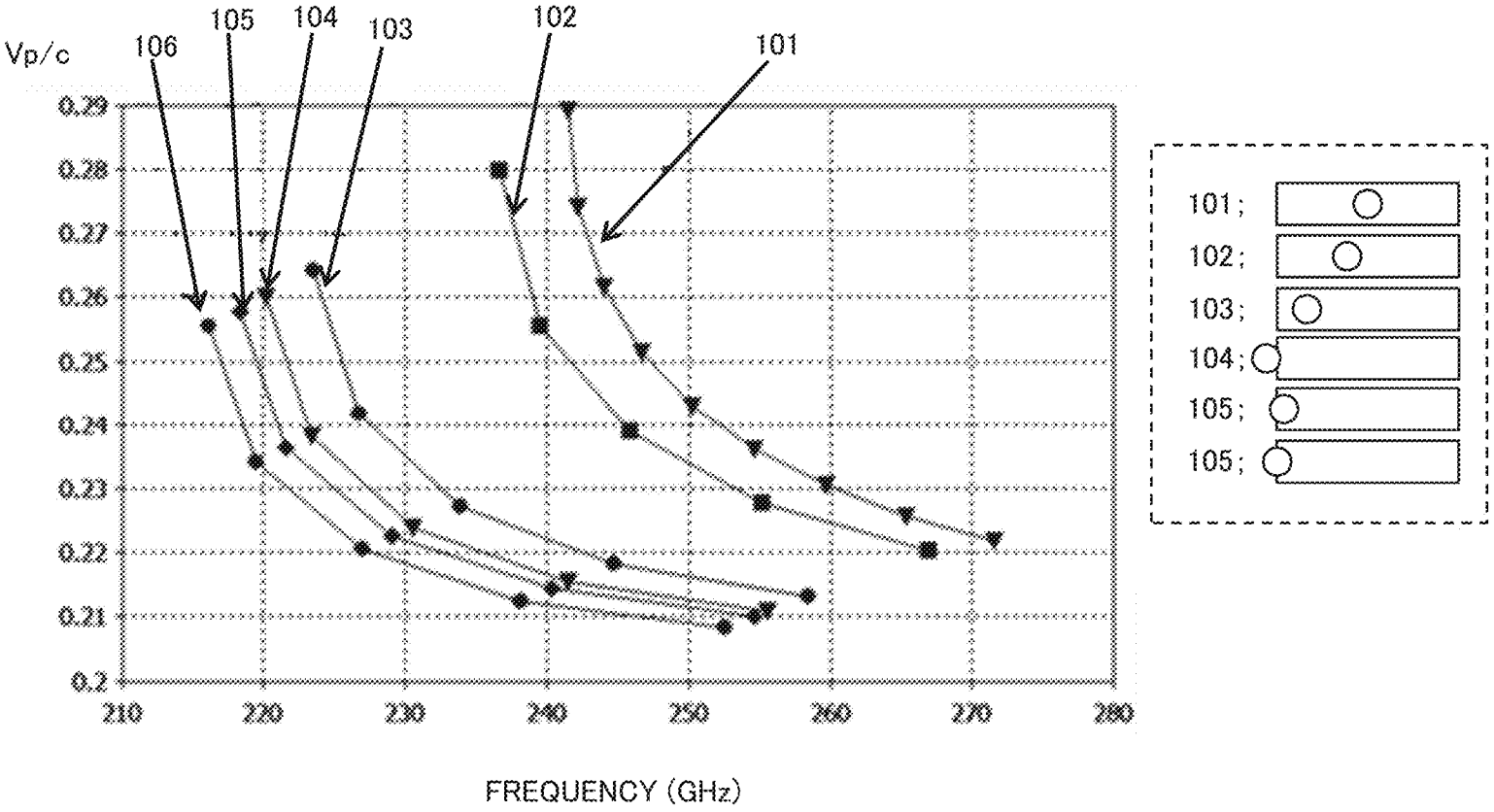
FIG. 3 is a diagram showing an example of a change of phase velocity Vp/c in the slow-wave circuit.

FIG. 3 is a diagram showing an example of change of phase velocity Vp/c in the slow-wave circuit 100. FIG. 3 shows change in phase velocity Vp/c in a case of moving the beam hole 10 in the direction of width of the folded waveguide 20 (movement from the center to an edge).

In FIG. 3, waveform 101 shows phase velocity Vp/c in a case where the beam hole 10 is positioned in the center of the folded waveguide 20. Waveform 102 indicates a waveform in a case where the beam hole 10 is moved a little to the left from the center of the folded waveguide 20, and waveform 103 indicates a waveform in a case where the beam hole 10 is moved farther to the left than the case of waveform 102. Waveforms 104 to 106 indicate waveforms in cases where the beam hole 10 is arranged at the edge of the folded waveguide 20, and the correspondence relationship of the waveform and the beam hole 10 position is as shown in the region enclosed by a broken line in FIG. 3.

Referring to FIG. 3, it is understood that following movement of the beam hole 10 to the edge, the slope of the waveform indicating phase velocity Vp/c gets smaller, and frequency deviation improves.

As may be understood from waveform 104 and the like, if the beam hole 10 is arranged to protrude more than halfway from the folded waveguide 20, it is understood that the slope of the abovementioned frequency characteristic again increases, and deviation worsens. However, if the beam hole 10 is arranged to protrude from the folded waveguide 20, interaction of a high frequency wave (electromagnetic wave) and an electron beam no longer occurs in a normal way, and gain is not obtained (a high frequency wave cannot be amplified). Therefore, structures in which the beam hole 10 is arranged to protrude from the folded waveguide 20 are excluded.

From the above, the beam hole 10 is preferably arranged at the edge in the direction of width of the folded waveguide 20, and at a position such that the beam hole 10 does not protrude from the folded waveguide 20. By the beam hole 10 being arranged at the abovementioned position, frequency deviation is minimized and the frequency band of the traveling-wave tube is widened. However, since in actuality it is necessary to consider manufacturing margin, the beam hole 10 is preferably arranged a little inside the edge of the folded waveguide 20 (that is, at a position separated by a prescribed distance from the edge).

Figure 4:
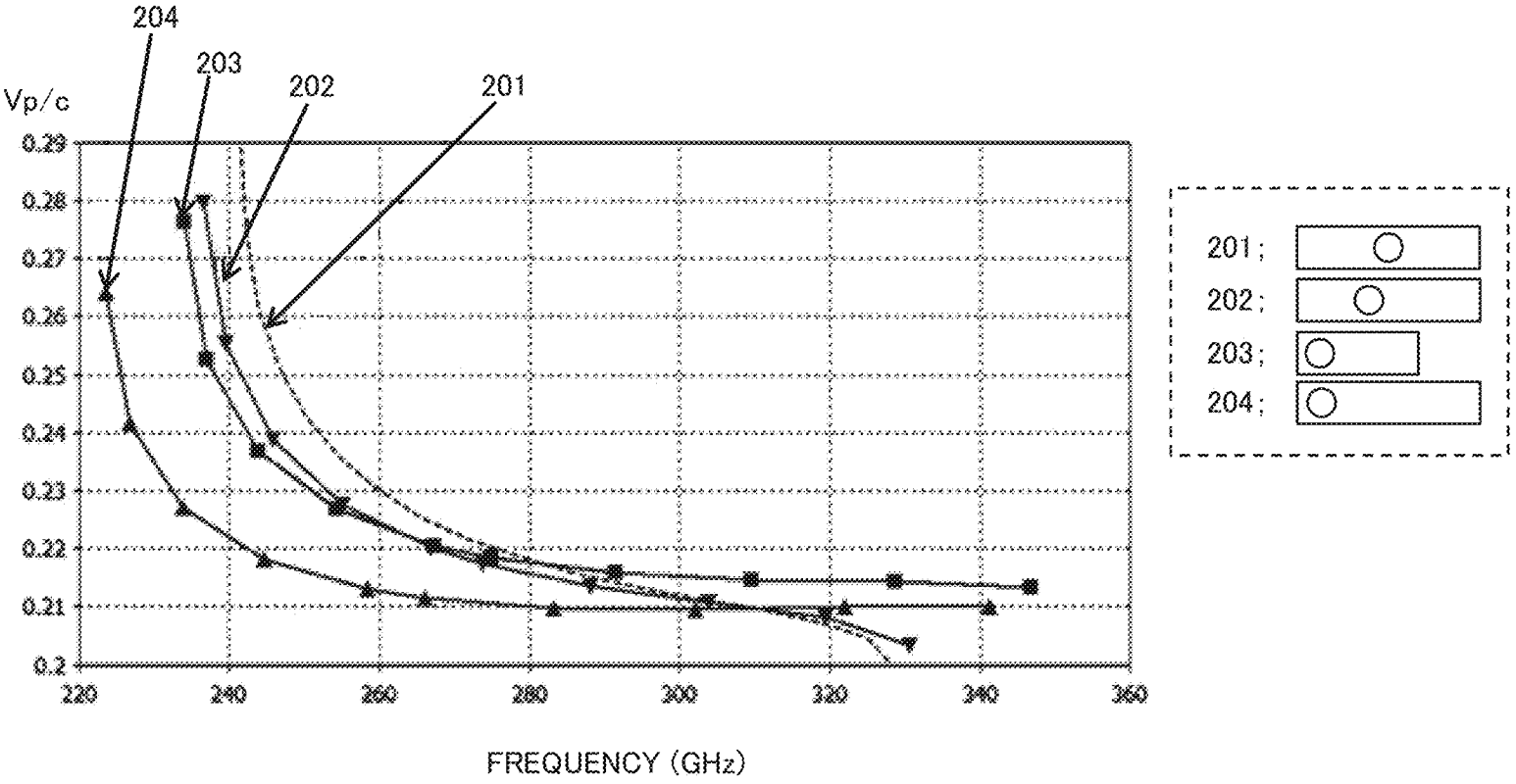
FIG. 4 is a diagram showing an example of change in phase velocity Vp/c in the slow-wave circuit for a high frequency range.

FIG. 4 is a diagram showing an example of change of phase velocity Vp/c in the slow-wave circuit 100 for a high frequency range. In FIG. 4, waveform 201 is a waveform showing phase velocity Vp/c in a case where the beam hole 10 is positioned in the center of the folded waveguide 20, and forms a reference (in FIG. 4 the waveform 201 is illustrated by a broken line). Waveform 202 indicates phase velocity Vp/c in a case where the beam hole 10 is positioned at the left side towards the center of the folded waveguide 20. Waveforms 203 and 204 indicate phase velocity Vp/c in a case where the beam hole 10 is positioned at the edge of the folded waveguide 20.

It is to be noted that the waveform 203 is a waveform after a cutoff frequency is adjusted by narrowing the width of the waveguide. The reason for adjusting the cutoff frequency is in order to inhibit decrease in the cutoff frequency by narrowing the width of the waveguide, since decrease in cutoff frequency is recognized if the beam hole 10 is moved to the edge of the folded waveguide 20.

Referring to FIG. 4, it is understood that if the beam hole 10 is moved to the edge of the folded waveguide 20, the slope in the vicinity of 300 GHz is improved, and the stopband occurring from the vicinity of reference standard (waveform 201) 330 GHz is also improved.

Comparing waveform 203 and 204, it is understood that even in a case where the cutoff frequency is adjusted, the abovementioned improvement effect can be anticipated.

Figure 5:
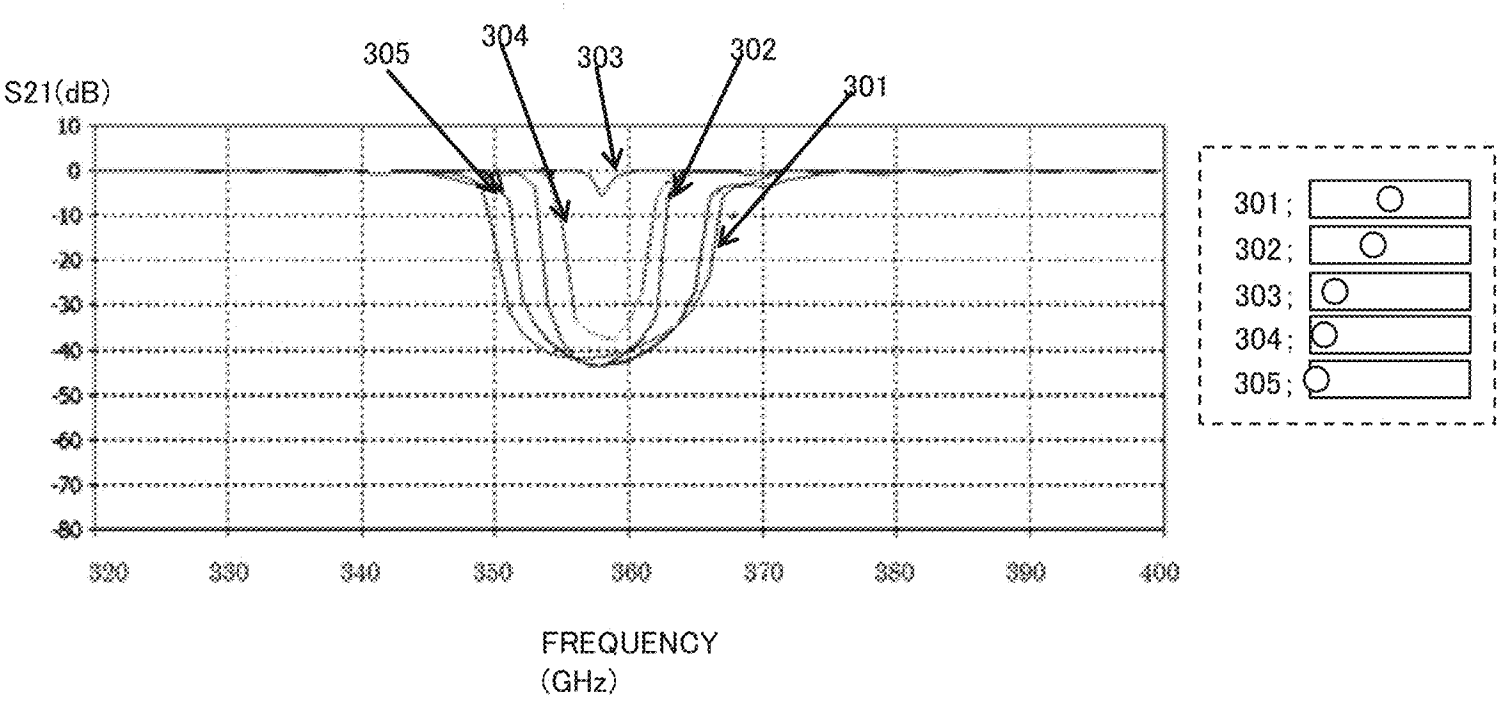
FIG. 5 is a diagram showing an example of change in stopband in a case where a beam hole is moved from the center to an edge of a folded waveguide.

FIG. 5 is a diagram showing an example of a change in stopband in a case where the beam hole 10 is moved from the center to the edge of the folded waveguide 20. It is to be noted that the stopband change is obtained by calculating an S parameter S21, which is an S parameter indicating insertion loss. That is, the calculation of the characteristic of the stopband vicinity may be performed using the S parameter.

In FIG. 5, waveform 301 indicates the S parameter S21 (insertion loss) in a case where the beam hole 10 is positioned in the center of the folded waveguide 20. Waveforms 302 to 305 respectively indicate the S parameter S21 in a case where the position of the beam hole 10 is moved to the left side from the center of the folded waveguide 20. Relationships between respective waveforms and position, with respect to the folded waveguide 20, of the beam hole 10, are as shown by the region enclosed by a dotted line in FIG. 5.

Referring to FIG. 5, it is understood that the stopband is smallest in a case where the beam hole 10 is positioned slightly more towards the center than the edge of the folded waveguide 20.

Figure 6B:
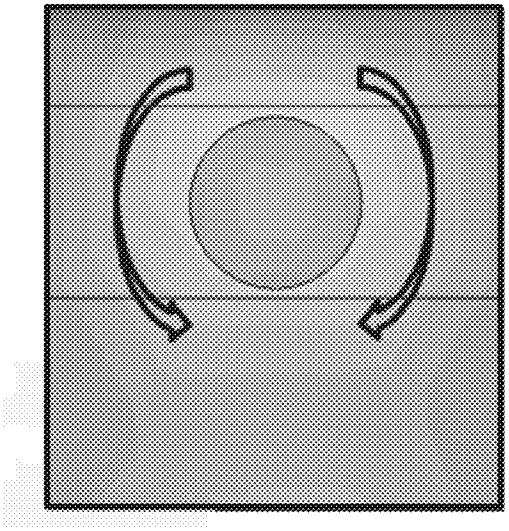
FIGS. 6A and 6B are diagrams showing an example of electromagnetic field distribution.
Figure 6A:
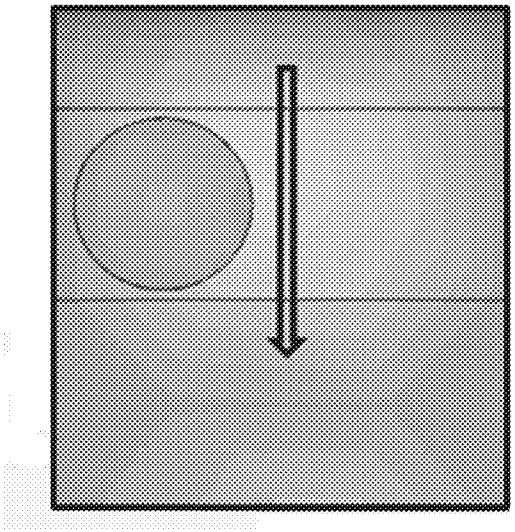

FIGS. 6A and 6B are diagrams showing an example of electromagnetic field distribution. FIG. 6A shows field distribution in a case where the beam hole 10 is arranged at the edge of the folded waveguide 20 as in the slow-wave circuit 100 according to the first exemplary embodiment. FIG. 6B shows field distribution in a case where the beam hole 10 is arranged at the center of the folded waveguide 20 as shown in FIG. 8. It is to be noted that in FIGS. 6A and 6B color density indicates the electromagnetic field distribution intensity.

Here, it is considered that according to the ratio of the beam hole 10 to the waveguide increasing, the increase in the slope of characteristic Vp/c–f or the appearance of a stopband is due to resonance among repeatedly appearing beam holes 10 when a high frequency wave (electromagnetic wave) travels in the folded waveguide (traveling-wave tube). That is, as shown in FIG. 6B, in a case where the beam hole 10 is positioned at the center of the folded waveguide 20, electromagnetic wave transmission is diverted to avoid the beam hole 10. On this occasion, it is considered that frequency distribution of phase velocity occurs. In this regard, as shown in FIG. 6A, when the beam hole 10 is positioned at the edge of the folded waveguide 20, the electromagnetic wave is linearly propagated and is flat, without frequency distribution of phase velocity occurring.

The appearance of the stopband is considered to be due to an electromagnetic wave being reflected by the beam hole(s) 10 and resonance occurring among the beam holes 10, and since reflection by the beam hole(s) 10 is reduced when the beam hole(s) 10 is arranged at the edge of the folded waveguide 20, the stopband also decreases.

Figure 7A:
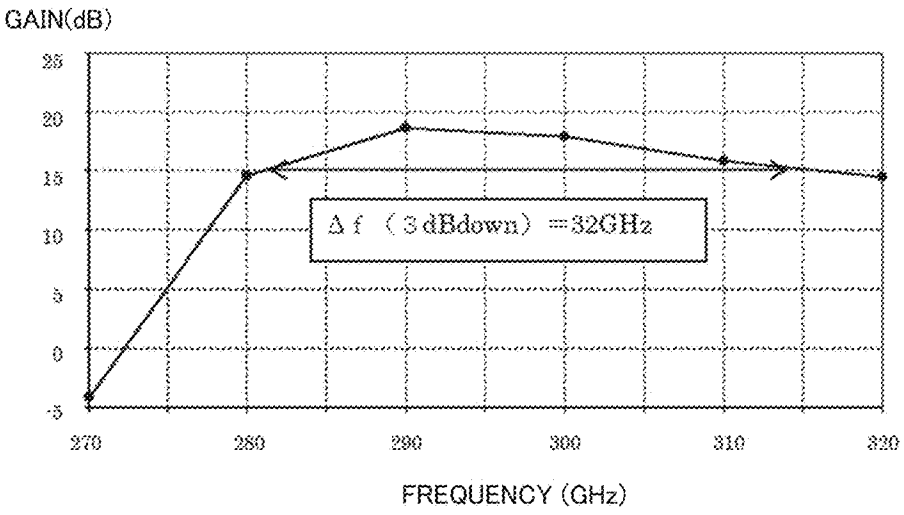
FIGS. 7A and 7B are diagrams showing an example of a result of gain calculation of a folded waveguide (traveling-wave tube).
Figure 7B:
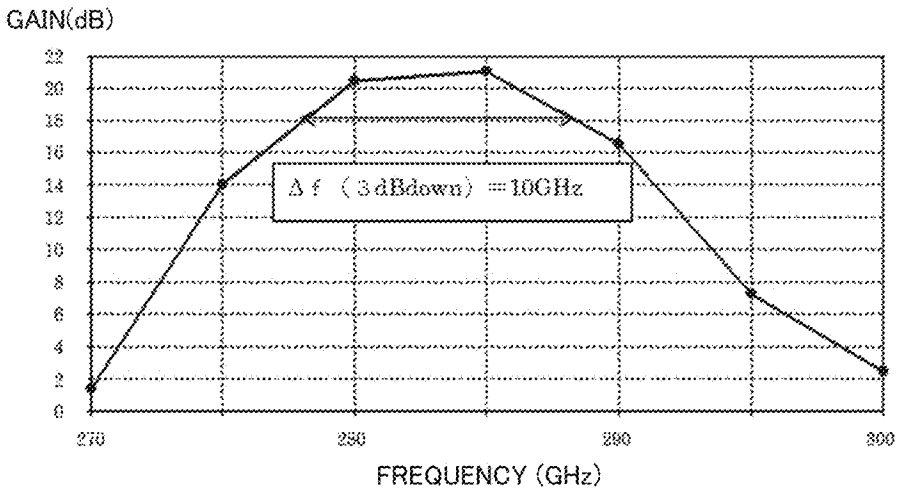

FIGS. 7A and 7B are diagrams showing an example of a result of gain calculation for the folded waveguide (traveling-wave tube). FIG. 7A shows gain in a case where the beam hole 10 is arranged at the edge of the folded waveguide 20 as in the slow-wave circuit 100 according to the first exemplary embodiment. FIG. 7B shows gain in a case where the beam hole 10 is arranged at the center of the folded waveguide 20 as shown in FIG. 8.

Referring to both diagrams shown in FIGS. 7A and 7B, with regard to bandwidth of 3 dB down being 10 GHz in the configuration of FIG. 8, in the configuration according to the first exemplary embodiment it is possible to widely ensure approximately 30 GHz. In this way, an improvement may be recognized in a band according to the slow-wave circuit 100 (folded waveguide, traveling-wave tube) according to the first exemplary embodiment.

It is to be noted that, as in the configuration shown in FIG. 8, with a large slope Vp/c–f, enlarging the band may be said to be impossible in principle. In the disclosure of the present application, besides the method of moving the beam hole 10 to the edge of the folded waveguide 20 and securing a wide band, a method may be considered where the beam hole 10 is gradually moved towards the edge and adjusted to an extent at which the required band is obtained. In the first exemplary embodiment, referring to FIG. 1 and the like, a description has been given concerning a case where the beam hole 10 is moved to the left side from the center of the folded waveguide 20, but clearly the beam hole 10 may also be moved towards the right side from the center.

As described above, in the slow-wave circuit 100 (traveling-wave tube) according to the first exemplary embodiment, the beam hole 10 of the folded waveguide 20 is formed, not at the center of the waveguide, but at an edge thereof. As a result, the slope approaches flatness in a usage band with regard to frequency characteristic of phase velocity in the traveling-wave tube, and it is possible to reduce the stopband. Therefore, a traveling-wave tube with broadband can be provided. By fine adjustment of the position of the beam hole 10, it is possible to control the frequency characteristic of the traveling-wave tube, and it is possible to improve the degree of freedom in band design to match an objective.

It is to be noted that the various disclosures of the cited Patent Literature described above are incorporated herein by reference thereto. Modifications and adjustments of exemplary embodiments and examples may be made within the ambit of the entire disclosure (including the claims) of the present invention, and also based on fundamental technological concepts thereof. Various combinations and selections of various disclosed elements (including respective elements of the respective claims, respective elements of the respective exemplary embodiments and examples, respective elements of the respective drawings, and the like) are possible within the ambit of the entire disclosure of the present invention. That is, the present invention clearly includes every type of transformation and modification that a person skilled in the art can realize according to the entire disclosure including the claims and to technological concepts thereof. In particular, with regard to numerical ranges described in the present description, arbitrary numerical values and small ranges included in the relevant ranges should be interpreted to be specifically described even where there is no particular description thereof.

What is claimed is:

1. A slow-wave circuit, comprising:

a folded waveguide, and a beam hole, which is the total area of a path of an electron beam in the folded waveguide, is arranged between an edge and a center in a direction of width of said folded waveguide, the direction of width being perpendicular to a traveling direction of an electromagnetic wave and being perpendicular to a height direction of the folded waveguide, the height direction extending from a bottom of the folded waveguide to a top of the folded waveguide, the top of the folded waveguide including a fold of the folded waveguide.

2. The slow-wave circuit according to claim 1, wherein said beam hole is arranged at an edge in the direction of width of said folded waveguide, at a position that does not protrude from said folded waveguide.

3. The slow-wave circuit according to claim 2, wherein said beam hole is at a position separated by a prescribed distance from an edge in the direction of width of said folded waveguide.

4. The slow-wave circuit according to claim 2, wherein said slow-wave circuit operates as a traveling-wave tube that amplifies an electromagnetic wave, by the electromagnetic wave being guided to said folded waveguide and the electron beam being guided to said beam hole.

5. The slow-wave circuit according to claim 1, wherein said beam hole is at a position separated by a prescribed distance from an edge in the direction of width of said folded waveguide.

6. The slow-wave circuit according to claim 5, wherein said slow-wave circuit operates as a traveling-wave tube that amplifies an electromagnetic wave, by the electromagnetic wave being guided to said folded waveguide and the electron beam being guided to said beam hole.

7. The slow-wave circuit according to claim 1, wherein said slow-wave circuit operates as a traveling-wave tube that amplifies an electromagnetic wave, by the electromagnetic wave being guided to said folded waveguide and the electron beam being guided to said beam hole.

* * * * *